US006616778B1

(12) United States Patent
Bodin

(10) Patent No.: US 6,616,778 B1
(45) **Date of Patent: *Sep. 9, 2003**

(54) PROCESS AND DEVICE FOR PRODUCING A FERRITICALLY ROLLED STEEL STRIP

(75) Inventor: André Bodin, Santpoort-Noord (NL)

(73) Assignee: Corus Staal BV, Ijmuiden (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/555,404

(22) PCT Filed: Dec. 8, 1998

(86) PCT No.: PCT/NL98/00699

§ 371 (c)(1),
(2), (4) Date: Jul. 6, 2000

(87) PCT Pub. No.: WO99/29446

PCT Pub. Date: Jun. 17, 1999

(30) Foreign Application Priority Data

Dec. 8, 1997 (NL) ..... 1007731

(51) Int. Cl.[7] ..... C21D 7/00

(52) U.S. Cl. ..... 148/541; 148/602; 148/656; 148/657; 148/658

(58) Field of Search ..... 148/541, 602, 148/656, 657, 658

(56) References Cited

U.S. PATENT DOCUMENTS

| | | | | |
|---|---|---|---|---|
| 3,753,796 | A | | 8/1973 | Melloy et al. |
| 4,316,753 | A | | 2/1982 | Kaneko et al. |
| 4,790,889 | A | | 12/1988 | Maid et al. |
| 4,861,390 | A | | 8/1989 | Satoh et al. |
| 5,470,529 | A | | 11/1995 | Nomura et al. |
| 5,802,902 | A | * | 9/1998 | Rosenthal et al. ..... 72/201 |

FOREIGN PATENT DOCUMENTS

| | | | |
|---|---|---|---|
| DE | 19520832 | | 4/1996 |
| DE | 19600990 | | 7/1997 |
| EP | 0370575 | | 5/1990 |
| EP | 0370575 A1 | * | 5/1990 |
| EP | 0524162 | | 1/1993 |
| EP | 0524162 A2 | * | 1/1993 |
| EP | 0750049 | | 12/1996 |
| JP | 61204331 | | 9/1986 |
| JP | 07242947 | | 9/1995 |
| JP | 07-242947 | * | 9/1995 |
| WO | 9200815 | | 1/1992 |
| WO | WO 97/01402 | * | 1/1997 |
| WO | 9746332 | | 12/1997 |

* cited by examiner

*Primary Examiner*—Roy King
*Assistant Examiner*—Janelle Combs-Morillo
(74) *Attorney, Agent, or Firm*—Stevens, Davis, Miller & Mosher, LLP

(57) ABSTRACT

A process for producing a ferritically rolled steel strip, in which liquid steel is cast in a continuous-casting machine (1) to form a slab and, utilizing the casting heat, is conveyed through a furnace device (7) undergoes preliminary rolling in a preliminary rolling device (10) and, in a final rolling device (14), is finishing-rolled to form the ferritic steel strip with a desired final thickness, in which process, in a completely continuous, an endless or a semi-endless process, the slab is rolled in the austenitic range in the preliminary rolling device (10) and, after rolling in the austenitic range, is cooled to a temperature at which the steel has a substantially ferritic structure, and the strip is rolled, in the final rolling device, at speeds which substantially correspond to the speed at which it enters the final rolling device (14) and the following thickness reduction stages, and in at least one stand of the final rolling device (14), the strip is ferritically rolled at a temperature of between 850° C. and 600° C., and after leaving the final rolling device (14), is cooled rapidly to a temperature below 500° C. in order substantially to avoid recrystallization.

23 Claims, 1 Drawing Sheet

PROCESS AND DEVICE FOR PRODUCING A FERRITICALLY ROLLED STEEL STRIP

FIELD OF THE INVENTION

The invention relates to a process for producing a ferritically rolled steel strip, in which liquid steel is cast in a continuous-casting machine to form a slab and, utilizing the casting heat, is conveyed through a furnace device, undergoes preliminary rolling in a preliminary rolling device and, in a final rolling device, is finishing-rolled to form the ferritic steel strip with a desired final thickness. A process of this nature is described in patent application PCT/NL97/00325, the content of which is hereby deemed to be incorporated in the present patent application. The invention also relates to a device for producing a steel strip, suitable in particular for carrying out a process according to the invention, comprising at least one continuous-casting machine for casting thin slabs, a furnace device for homogenizing a slab, which has optionally undergone preliminary reduction, and a rolling device for rolling the slab down to a strip with the desired final thickness, and a coiler device for coiling the strip. A device of this nature is also known from patent application PCT/NL97/00325.

BACKGROUND OF THE INVENTION

PCT/NL97/00325 describes a completely continuous, endless or semi-endless process for producing a steel strip which has undergone at least one rolling step in the ferritic range. The strip emerging from the final rolling device is coiled onto a coiler device, which is disposed downstream of the final rolling device, at a temperature which is such that recrystallization occurs on the coil.

SUMMARY OF THE INVENTION

Surprisingly, it has been found that the process is particularly suitable for producing a steel strip with particular properties. In this process, use is made of particular aspects of the device as described in application PCT/NL97/00325. In particular, these aspects relate to the very good control and homogeneity of the temperature of the slab or of the strip both in the width direction and in the thickness direction. The temperature is also homogeneous in the longitudinal direction, since the rolling process proceeds at a steady speed and therefore no acceleration or deceleration is required during rolling, due to the continuous, semi-endless or endless options which the device offers for rolling a ferritic strip.

The temperature homogeneity as a finction of time is also better than that which can be achieved using conventional installations. In addition, the device offers the possibility of carrying out rolling in a lubricating manner on one or more rolling mill stands. Also, cooling devices are provided at various locations in the device, so that the temperature profile of the steel slab or the steel strip can be controlled particularly successfully during its passage through and emergence from the installation.

In addition, particularly when using a vacuum tundish, the chemical composition of the steel can be particularly finely matched to the desired product properties. Moreover, owing to the good level of temperature homogeneity, the device allows a ferritic range which is very broad, i.e. extends over a wide temperature range, as explained in the patent application mentioned above.

It has been found that the known process provides a steel strip with particularly good deformation properties in an embodiment which, according to the invention, is characterized in that in a completely continuous, an endless or a semi-endless process, the slab is rolled in the austenitic range in the preliminary rolling device and, after rolling in the austenitic range, is cooled to a temperature at which the steel has a substantially ferritic structure, and the strip is rolled, in the final rolling device, at speeds which substantially correspond to the speed at which it enters the final rolling device and the following thickness reduction stages, and in at least one stand of the final rolling device, the strip is ferritically rolled at a temperature of between 850° C. and 600° C., and, after leaving the final rolling device, is cooled rapidly to a temperature below 500° C. in order substantially to avoid recrystallization.

The invention works on the basis that, by cooling the ferritically rolled strip rapidly after it leaves the final rolling device, no recrystallization, or little recrystallization, occurs, and at least part of the structure which has undergone deformation in the high ferritic range is maintained. The ferritically rolled steel strip obtained in this way may, furthermore, undergo a cold ferritic reduction in the manner which is known per se, for example in such a manner that the total ferritic reduction lies in the vicinity of 70 to 80%, part of which is applied in the hot ferritic state and part in the cold ferritic state. The result is a cold-rolled steel strip with a high r-value and a low Δr-value. By way of indication, it can be stated that the slab thickness may be approx. 70 mm and the thickness of the reduced slab at the transition from the austenitic range to the ferritic range lies in the range between 15 and 40 mm. Rapidly cooling the hot-rolled ferritic strip to a temperature below 500° C. prevents the deformation structure from being lost as a result of recrystallization.

DE-A-19520832 also describes a process for producing a ferritically rolled steel strip starting from liquid steel cast in a continuous-casting machine. The rolled steel strip is cooled before coiling. It is not disclosed, however, that casted slabs are conveyed through a furnace, nor that the cooling is performed so rapidly that recrystallization is avoided. WO-A92/00815 discloses a comparable process in which the strip is cooled prior to entering the last rolling stand. Again there is no disclosure about rapidly cooling which results in avoiding recrystallization.

DE-A-19600990 relates to combined austenitic and subsequent ferritic rolling. Prior to the ferritic rolling the strip is cooled. A further cooling after the ferritic rolling has not been specified.

In addition to a good temperature distribution, a good distribution of the reduction in size brought about by rolling across the thickness and width of the slab or strip is also of particular importance. Therefore, it is preferable to carry out the process in such a manner that, on at least one rolling stand at which ferritic rolling is carried out, lubrication rolling is carried out, and more particularly in such a manner that, on all the rolling stands at which ferritic rolling is carried out, lubrication rolling is carried out.

A further improvement to the stress distribution and the reduction distribution through the cross section of the slab or strip is achieved by means of a process which is characterized in that, on at least one rolling mill stand of the preliminary rolling device, rolling is carried out in a lubricating manner.

Particularly good deformation properties, i.e. high r-values and low Δr-values, are obtained by means of an embodiment of the process which is characterized in that the steel is an IF steel. A steel of this nature makes it possible to achieve an r-value of approx. 3. It is preferable to use an IF steel of heavy analysis with a sufficiently high titanium content and a suitably matched sulphur content, so that no interstices are formed during the ferritic rolling. A strip of this nature is particularly suitable as deep-drawing steel and as a starting material for coated strip, in particular galvanized strip.

Another embodiment of the process according to the invention is characterized in that the steel is a low-carbon steel. The known process for making DWI steels makes it possible to achieve r-values in the vicinity of 1.1. In the packing steel world, an r-value of 1.2 is desirable. With the process according to the invention, it is readily possible to achieve an r-value of 1.3 or more. The background to this is that, in contrast to the traditional method of producing DWI steel, using the process according to the invention it is possible to achieve a good starting value of the texture giving rise to the desired r-value of 1.3. In this context, low-carbon steel is understood to mean a steel with a carbon concentration of between 0.01 and 0.1%, preferably between 0.01 and 0.07%.

In order to achieve the desired high cooling rate, a further embodiment of the process according to the invention is characterized in that the strip, after leaving the final rolling device, is cooled by a cooling device with a cooling capacity of more than 2 $MW/m^2$. In order to keep the distance between final rolling device and coiling device as short as possible and to achieve a high level of flexibility in terms of cooling rate, a further embodiment of the process according to the invention is characterized in that the cooling device has a cooling capacity of more than 3 $MW/m^2$.

Such cooling rates can be achieved by means of a process which, according to the invention, is characterized in that, in the cooling device, use is made of water which is sprayed onto the slab by coherent jets placed with a high position density.

A cooling device which allows the cooling rates which are desirable according to the invention to be achieved is described, inter alia, in the final report of an ECSC project No. 7210-EA/214, the content of which is hereby deemed to be incorporated in the present application. A significant advantage of the cooling device which is known from this report is the wide range over which cooling capacity can be regulated, the homogeneity of the cooling and the high cooling capacity per unit surface area Selecting a high cooling capacity of this nature makes it possible to achieve the desired cooling rate at the exit speeds which arise in a continuous, endless or semi-endless rolling process.

The invention is also embodied by a device for producing a steel strip, suitable in particular for carrying out a process according to the invention, comprising at least one continuous-casting machine for casting thin slabs, a furnace device for homogenizing a slab, which has optionally undergone preliminary size reduction, and a rolling device for rolling the slab down to a strip with the desired final thickness in a preliminary rolling device, and a coiler device for coiling the strip.

Surprisingly, it is now been found that the so-called close-in-coiler directly downstream of the rolling mill stand can be avoided by an embodiment of the device which is characterized in that a cooling device with a cooling capacity of at least 2 $MW/m^2$ is placed between the final rolling mill stand of the rolling device and the coiler device.

In the past, numerous proposals have been made for devices and processes for achieving a high cooling rate of a steel strip downstream of a rolling device and upstream of a coiler device. In the case of a device as described in PCT/NL97/00325, it is possible to produce both a ferritically rolled strip which recrystallizes on the coil and an austenitically rolled strip. In addition, the device is particularly suitable for producing a ferritically rolled steel strip according to the present invention. When producing a ferritic strip which recrystallizes on the coil, it is attempted to keep the cooling of the strip after it leaves the find rolling device as low as possible and therefore to employ a coiler device which is positioned as close as possible downstream of the final rolling device (close-in-coiler). If an austenitically rolled steel strip is being produced, this strip has to be cooled before being coiled. Therefore, the close-in-coiler which has just been mentioned is not suitable for this purpose, and a second coiler device following the cooling device is desirable. If the cooling capacity of the cooling device is high, the length over which cooling is carried out is short and the close-in-coiler can be omitted, a fact which provides the additional advantage of considerable savings.

Given a high cooling capacity of this nature, the distance between the exit sides of the final rolling device and the coiler following the cooling device is so short that the fall in temperature of a ferritically rolled steel strip over this distance is also so low that it has still proven possible to coil the strip at a temperature at which recrystallization takes place on the coil.

BRIEF DESCRIPTION OF THE DRAWINGS

The invention will now be explained in more detail with reference to a non-limiting embodiment according to the drawing, in which.

DETAILED DESCRIPTION OF THE PREFERRED EMBODIMENTS

Figure 1:
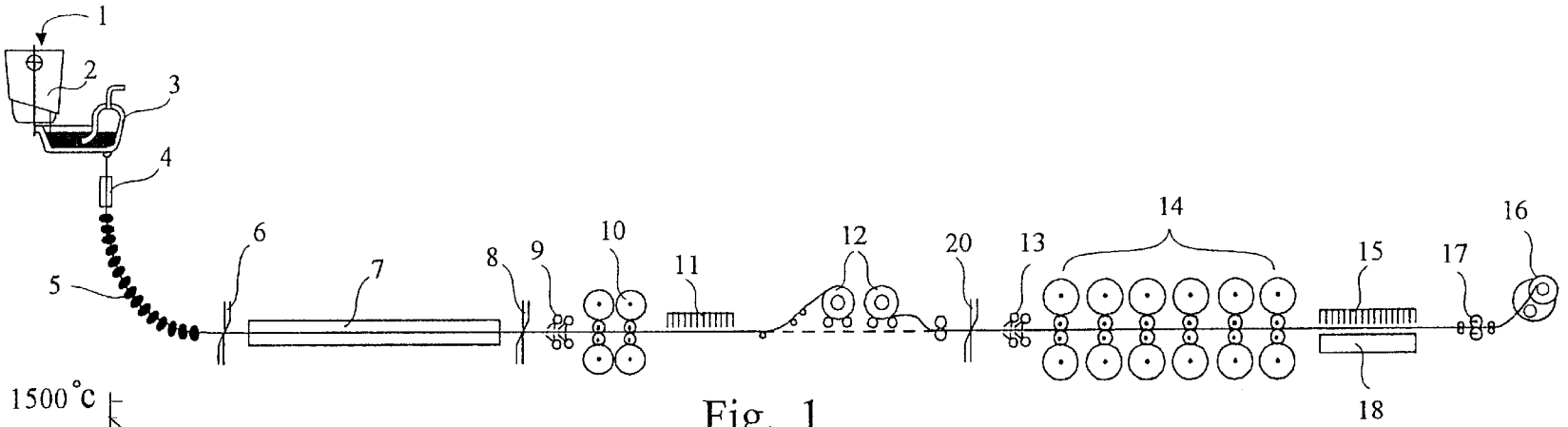
FIG. 1 shows a diagrammatic side view of a device with which the process according to the invention can be carried out.

In FIG. 1, reference numeral 1 indicates a continuous-casting machine for casting thin slabs. In this introductory description, this term is understood to mean a continuous-casting machine for casting thin slabs of steel with a thickness of less than 150 mm, preferably less than 100 mm, more preferably less than 80 mm. The continuous-casting machine may comprise one or more strands. It is also possible for a plurality of casting machines to be positioned next to one another. These embodiments fall within the scope of the invention. Reference numeral 2 indicates a casting ladle from which the liquid steel which is to be cast is fed to a tundish 3, which in this design is in the form of a vacuum tundish. The tundish is preferably provided with means, such as metering means, mixing means and analysis means, for setting the chemical composition of the steel to a desired composition, since in the present invention the composition is important. Beneath the tundish 3, there is a casting mould 4 into which the liquid steel is cast and at least partially solidified. If desired, casting mould 4 may be equipped with an electromagnetic brake. The standard continuous-casting machine has a casting speed of approx. 6 m/min; additional measures, such as a vacuum tundish and/or an electromagnetic brake provide the prospect of casting rates of 8 m/min or more. The solidified thin slab is introduced into a tunnel furnace 7 which has a length of, for example, 250–330 m. As soon as the cast slab has reached the end of the furnace 7, the slab is cut into slab sections in a semi-endless process using the shearing device 6. A semi-endless process is understood to mean a process in which a number of coils, preferably more than three, more preferably more than five coils, of the standard coil size are rolled from a single slab or slab section, in a continuous rolling process in at least the final rolling device, so as to give the final thickness. In an endless rolling process, the slabs or, after the preliminary rolling device, strips are coupled together so that an endless rolling process can be carried out in the final rolling device. In a continuous process, a slab moves through the path between continuous-casting machine and exit side of the rolling device without interruption. The invention is explained here on the basis of a semi-endless process, but can obviously also be used for an endless or continuous process. Each slab section represents a quantity of steel corresponding to five to six conventional coils. In the furnace, there is room to store a number of slab sections of this nature, for example to store three slab sections. As a result, those parts of the installation which lie downstream of the furnace can continue to operate while the casting ladle in the continuous-casting machine is being changed and the casting of a new slab is to commence, and ensures that the continuous-casting machine can continue to operate if a fault arises downstream. Also, storage in the furnace increases the residence time of the slab sections therein, resulting in improved temperature homogenization of the slab sections. The speed at which the slab enters the furnace corresponds to the casting speed and is therefore approx. 0.1 m/sec. Downstream of furnace 7, there is an oxide-removal device 9, in this case in the form of high-pressure water jets with a pressure of approx. 400 atmosphere, for blasting off the oxide which has formed on the surface of the slab. The speed at which the slab passes through the oxide-removal installation and enters the rolling device 10 is approx. 0.15 m/sec. The rolling device 10, which fulfils the function of the preliminary rolling device, comprises two four-high stands, which are preferably equipped with a device for roller lubrication. If desired, a shearing device 8 may be included for emergency situations.

Figure 2:
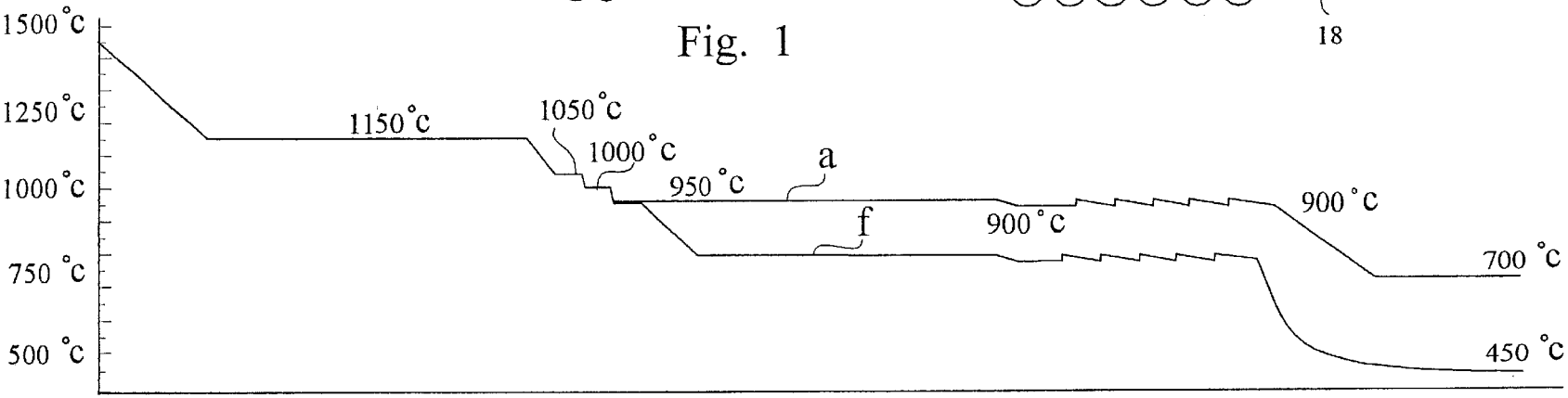
FIG. 2 shows a graph illustrating the temperature profile in the steel as a function of the position in the device.
Figure 3:
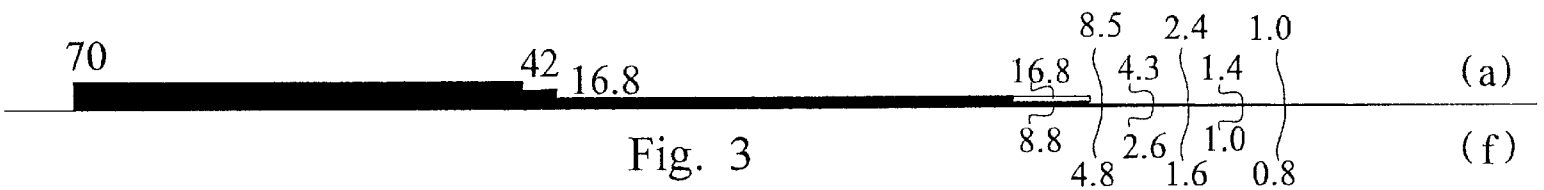
FIG. 3 shows a graph illustrating the thickness profile of the steel as a function of the position in the device.

It can be seen from FIG. 2 that the temperature of the steel slab, which is approximately 1450° C. on leaving the tundish, falls in the rolling stand to a level of approx. 1150° C., and the slab is homogenized in the furnace device at that temperature. The intensive spraying with water in the oxide-removal device 9 causes the temperature of the slab to fall from approximately 1150° C. to approximately 1050° C. This applies both for the austenitic process and for the ferritic process, a and f respectively. In the two rolling mill stands of the preliminary rolling device 10, the temperature of the slab falls, with each roller increment, by another approximately 50° C., so that the slab, the thickness of which was originally approximately 70 mm and which is formed in two steps, with an interim thickness of 42 mm, into a steel strip with a thickness of approx. 16.8 mm, is at a temperature of approximately 950° C. The thickness profile as a function of the location is shown in FIG. 3. The numbers indicate the thickness in mm. A cooling device 11, a set of coil boxes 12 and, if desired, an additional furnace device (not shown) are accommodated downstream of the preliminary rolling device 10. During the production of an austenitically rolled strip, the strip emerging from the rolling device 10 may be temporarily stored and homogenized in the coil boxes 12, and if an additional increase in temperature is required, may be heated in the heating device (not shown) which is positioned downstream of the coil box. It would be obvious to the person skilled in the art that coiling device 11, coil boxes 12 and the furnace device which is not shown may be in different positions with respect to one another from those mentioned above. As a result of the reduction in thickness, the rolled strip enters the coil boxes at a speed of approx. 0.6 m/sec. A second oxide-removal installation 13, water pressure approximately 400 atmosphere, is positioned downstream of the cooling device 11, coil boxes 12 or furnace device (not shown), for the purpose of again removing an oxide skin which may have formed on the surface of the rolled strip. If desired, another shearing device may be included so as to top and tail a strip. The strip is then introduced into a rolling train which may be in the form of six four-high rolling mill stands which are positioned one behind the other and are preferably constructed with a device for roller lubrication.

When producing an austenitic strip, it is possible to achieve the desired final thickness of between, for example, 1.0 and 0.6 mm by using only five rolling mill stands. The thickness which is achieved by each rolling mill stand is indicated, for a slab thickness of 70 mm, in the top row of figures in FIG. 3. After leaving the rolling train 14, the strip, which is then at a final temperature of approximately 900° C. and has a thickness of 0.6 mm, is intensively cooled by means of a cooling device 15 and is coiled onto a coiler device 16. The speed at which it enters the coiler device is approx. 13–25 m/sec.

If a ferritically rolled steel strip according to the invention is to be produced, the steel strip emerging from the preliminary rolling device 10 is intensively cooled by means of cooling device 11. This cooling device may also be incorporated between rolling stands of the final rolling device. It is also possible to employ natural cooling, optionally between rolling stands. Then, the strip spans coil boxes 12 and, if desired, the furnace device (not shown), and oxide is then removed in oxide-removal installation 13. The strip, which is by now in the ferritic range, is then at a temperature of approximately 750° C. In this case, a further part of the material may still be austenitic but, depending on the carbon content and the desired final quality, this may be acceptable. In order to provide the ferritic strip with the desired final thickness of between, for example, 0.8 and 0.5 mm, all six stands of the rolling train 14 are used.

As in the situation where an austenitic strip was being rolled, for rolling a ferritic strip an essentially equal reduction in thickness is used for each rolling mill stand, with the exception of the reduction carried out by the final rolling mill stand. All this is illustrated in the temperature profile in accordance with FIG. 2 and the thickness profile in accordance with the bottom row of FIG. 3 for ferritic rolling of the steel strip as a function of the position. The temperature profile shows that the strip, on emerging, is at a temperature which is well above the recrystallization temperature. Therefore, in order to prevent the formation of oxide, it may be desirable to use a cooling device 15 to cool the strip to the desired coiling temperature, at which recrystallization may still take place. If the exit temperature from rolling train 14 is too low, it is possible to bring the ferritically rolled strip up to a desired coiling temperature by means of a furnace device 18 which is positioned downstream of the rolling train. In the process according to the invention, the ferritically rolled steel strip, after it leaves the rerolling device 14, is cooled very rapidly, by means of cooling device 15, to a temperature at which at least a considerable part of the structure made during rolling is maintained. Cooling to below 500° C. is sufficient for this purpose.

Owing to the high speed at which the ferritically rolled strip exits the rerolling device 14, and in order to keep the distance over which cooling is carried out low, cooling device 15 has a very high cooling capacity, of more than 2 and preferably more than 3 $MW/m^2$.

Because the cooling device 15 is very short, the distance between the exit side of the rerolling device 14 and the coiler device 16, which in this case is in the form of a so-called carousel coiler, is also short. As a result, coiler device 15 can also be used in the conventional process for producing ferritic strip in which the steel recrystallizes on the coil. A so-called close-in-coiler immediately downstream of the exit side of the rerolling device 14, in order to limit the fall in temperature between the rerolling device 14 and a coiler device, is therefore not required.

Cooling device 15 and furnace device 18 may be positioned next to one another or one behind the other. It is also possible to replace one device with the other device depending on whether ferritic or austenitic strip is being produced. Rolling can be carried out endlessly or continuously when producing a ferritic strip. This means that the strip emerging from the rolling device 14 and, if appropriate, cooling device or furnace device 15 or 18, respectively, has a greater length than is usual for forming a single coil and that a slab section with the length of a complete furnace, or even a longer slab section, is rolled continuously. A shearing device 17 is included in order to cut the strip to the desired length, corresponding to standard coil dimensions. By suitably selecting the various components of the device and the process steps carried out using this device, such as homogenization, rolling, cooling and temporary storage, it has proven possible to operate this device with a single continuous-casting machine, whereas in the prior art two continuous-casting machines are used in order to match the limited casting speed to the much higher rolling speeds which are customarily employed. If desired, an additional so-called close-in-coiler may be accommodated immediately downstream of the rolling train 14 in order to assist with controlling the strip movement and the strip temperature, but this is not necessary, as indicated above. The device is suitable for strips with a width which lies in the range between 1000 and 1500 mm and a thickness of approximately 1.0 mm in the case of an austenitically rolled strip and of approximately 0.5 to 0.6 mm in the case of a ferritically rolled strip. The homogenization time in the furnace device 7 is approximately ten minutes for storing three slabs of the length of the furnace. The coil box is suitable for storing two complete strips in the case of austenitic rolling.

What is claimed is:

1. A process for producing a ferritically rolled steel strip, comprising:

casting liquid steel in a continuous-casting machine to form a slab having a thickness of less than 150 mm;

conveying the slab, utilizing the casting heat, through a furnace device; preliminary rolling of the slab in a preliminary rolling device; and finishing rolling of the slab, after preliminary rolling, in a final rolling device to form the ferritic steel strip with a desired final thickness;

wherein, in an endless or a semi-endless process, the slab is rolled in the austenitic range in the preliminary rolling device and, after rolling in the austenitic range, is cooled to a temperature at which the steel has a substantially ferritic structure, and the strip is rolled, in the final rolling device, at speeds which substantially correspond to the speed at which the strip enters the final rolling device and the following thickness reduction stages of the final rolling device, and in at least one stand of the final rolling device, the strip is ferritically rolled at a temperature of between 850° C. and 600° C., and cooling the steel strip, after leaving the final rolling device, rapidly to a temperature below 500° C. in order substantially to avoid recrystallization.

2. The process according to claim 1, wherein said ferritic rolling comprises lubrication rolling on at least one rolling stand at which ferritic rolling is carried out.

3. The process according to claim 1, wherein said ferritic rolling comprises lubrication rolling on all the rolling stands at which ferritic rolling is carried out.

4. The process according to claim 1, wherein said ferritic rolling comprises lubrication rolling on at least one rolling mill stand of the preliminary rolling device.

5. The process according to claim 1, wherein the steel is an IF steel.

6. The process according to claim 1, wherein the steel is a low carbon steel.

7. The process according to claim 1, wherein said cooling after leaving the final rolling device comprises cooling the strip by a cooling device with a cooling capacity of more than 2 $MW/m_2$.

8. The process according to claim 7, wherein the cooling device has a cooling capacity of more than 3 $MW/M^2$.

9. The process according to claim 7, wherein the cooling after leaving the final rolling device comprises spraying water onto the slab by coherent jets placed with a high position density.

10. The process according to claim 1, wherein the steel is selected from the group consisting of IF steel and a low carbon steel and has an r-value of approximately 3.

11. The process according to claim 1, wherein the steel is selected from the group consisting of IF steel and a low carbon steel and has an r-value of 1.3 or more.

12. The process according to claim 1, wherein the steel is selected from the group consisting of IF steel and a low carbon steel and has an r-value of between 1.1 and 1.3.

13. The process according to claim 1, wherein the steel is selected from the group consisting of IF steel and a low carbon steel and has an r-value of 1.2.

14. The process according to claim 1, wherein the slab has a thickness of from 15 to 40 mm at the transition from austenite to ferrite.

15. The process according to claim 1, wherein the cast slab has a thickness of less than 100 mm.

16. The process according to claim 15, wherein the cast slab has a thickness of less than 80 mm.

17. The process according to claim 1, further comprising making a plurality of coils from a single said strip by steps comprising cutting each said ferritically rolled strip into portions downstream of said finishing rolling, and coiling a plurality of said portions into a respective plurality of coils.

18. The process according to claim 17, wherein three to six coils are coiled from each said ferritically rolled steel strip.

19. The process according to claim 17, wherein five to six coils are coiled from each said ferritically rolled steel strip.

20. The process according to claim 1, wherein said slabs are coupled together so that an endless rolling process occurs in the final rolling device.

21. The process according to claim 1, wherein after the preliminary rolling the strips are coupled together so that an endless rolling process occurs in the final rolling device.

22. The process according to claim 1, wherein the cooling step maintains at least a considerable part of a microstructure which has undergone deformation between 850° C. and 600° C. in the ferritic range and the ferritically rolled steel strip has an r-value of at least 1.1.

23. The process according to claim 1, wherein in the semi-endless process, the slab is rolled in the austenitic range in the preliminary rolling device and, after rolling in the austenitic range, is cooled to the temperature at which the steel has the substantially ferritic structure, and the strip is rolled, in the final rolling device, at speeds which substantially correspond to the speed at which the strip enters the final rolling device and the following thickness reduction stages of the final rolling device, and in at least one stand of the final rolling device, the strip is ferritically rolled at the temperature of between 850° C. and 600° C.

* * * * *